US011424547B2

(12) United States Patent
Kim

(10) Patent No.: US 11,424,547 B2
(45) Date of Patent: Aug. 23, 2022

(54) ANTENNA APPARATUS AND VEHICLE

(71) Applicants: HYUNDAI MOTOR COMPANY, Seoul (KR); KIA MOTORS CORPORATION, Seoul (KR)

(72) Inventor: Dongjin Kim, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 17/116,077

(22) Filed: Dec. 9, 2020

(65) Prior Publication Data

US 2021/0336352 A1 Oct. 28, 2021

(30) Foreign Application Priority Data

Apr. 27, 2020 (KR) ..... 10-2020-0050671

(51) Int. Cl.
*H01Q 13/10* (2006.01)
*H01Q 21/29* (2006.01)
*H01Q 1/12* (2006.01)

(52) U.S. Cl.
CPC ..... *H01Q 13/106* (2013.01); *H01Q 1/1271* (2013.01); *H01Q 21/29* (2013.01)

(58) Field of Classification Search
CPC .... H01Q 1/1271; H01Q 13/10; H01Q 13/103; H01Q 13/106; H01Q 13/16; H01Q 13/18; H01Q 21/08; H01Q 21/10; H01Q 21/29
See application file for complete search history.

(56) References Cited

U.S. PATENT DOCUMENTS 7,696,948 B2 * 4/2010 Abramov ..... H01Q 1/2291 343/876
2005/0162327 A1 * 7/2005 Mori ..... H01Q 9/0442 343/770

* cited by examiner

*Primary Examiner* — Robert Karacsony
(74) *Attorney, Agent, or Firm* — Morgan, Lewis & Bockius LLP

(57) ABSTRACT

An antenna apparatus includes: a conductive plate having a plurality of slot groups; a plurality of feeding lines; and a dielectric disposed between the conductive plate and the plurality of feeding lines. Each of the plurality of slot groups may include a main slot, a sub slot, and a slot coupler defined in the conductive plate. The main slot, the sub slot, and the slot coupler may be configured to penetrate through the conductive plate. The slot coupler may be configured to extend from the sub slot toward the main slot.

18 Claims, 12 Drawing Sheets

ANTENNA APPARATUS AND VEHICLE

CROSS-REFERENCE TO RELATED APPLICATION(S)

This application is based on and claims the benefit of priority to Korean Patent Application No. 10-2020-0050671, filed on Apr. 27, 2020 in the Korean Intellectual Property Office, the disclosure of which is incorporated by reference in its entirety.

TECHNICAL FIELD

The present disclosure relates to an antenna apparatus and a vehicle having the same, and more particularly, to an antenna apparatus installed in a front window or a rear window, and a vehicle having the same.

BACKGROUND

A vehicle is a moving means or transportation means for driving on a road and railway using fossil fuels and/or electricity as a power source.

The vehicle generally includes an audio device and a video device to allow a driver to listen to music and to watch a video. Furthermore, a navigation system has been commonly provided in the vehicle to display a route to a destination to the driver.

There has been a growing demand for the vehicle to communicate with an external device (or external vehicles). For example, the need for vehicle to vehicle (V2V) communication with a preceding vehicle and/or a following vehicle is increasing.

For smooth V2V communication with a preceding vehicle and/or a following vehicle, it is preferable to arrange an antenna for transmitting/receiving radio signals at the front and/or rear of the vehicle.

The information disclosed in the Background section above is to aid in the understanding of the background of the present disclosure, and should not be taken as acknowledgement that this information forms any part of prior art.

SUMMARY

An aspect of the present disclosure is to provide an antenna apparatus disposed in a front window and/or a rear window.

Another aspect of the present disclosure is to provide an antenna apparatus capable of beam-forming from an inclined front window and/or a rear window toward the front and/or rear of a vehicle.

Additional aspects of the present disclosure will be set forth in part in the description which follows and, in part, will be obvious from the description, or may be learned by practice of the disclosure.

In accordance with an aspect of the present disclosure, an antenna may include: a conductive plate having a plurality of slot groups; a plurality of feeding lines; and a dielectric disposed between the conductive plate and the plurality of feeding lines. Each of the plurality of slot groups may include a main slot, a sub slot, and a slot coupler defined in the conductive plate. The main slot, the sub slot, and the slot coupler may be configured to penetrate through the conductive plate. The slot coupler may be configured to extend from the sub slot toward to be adjacent the main slot.

Each of the main slots may have a width in a direction of a long axis that is longer than a width in a direction of a short axis.

Another main slot adjacent to the main slot may be provided spaced apart from the main slot in the direction of the long axis of the main slot.

Another main slot adjacent to the main slot may be provided spaced apart from the main slot in the direction of the short axis of the main slot.

The sub slot may be provided spaced apart from the main slot in the direction of the long axis of the main slot.

Each of the plurality of feeding lines may be configured to extend in the direction of the short axis of the main slot so as to cross the main slot.

The slot coupler may include a coupling inductor extending parallel to the main slot in the vicinity of the main slot, a slot connector connected to the sub slot, and a phase delay provided between the coupling inductor and the slot connector.

The phase delay may be an alphabetic S shape that extends from the coupling inductor to the slot connector.

The slot coupler may be configured to couple the sub slot to the main slot.

In accordance with another aspect of the present disclosure, a vehicle may include: a front window; a wireless communication device; and an antenna apparatus disposed on the front window and configured to be electrically connected to the wireless communication device. The antenna apparatus may include a conductive plate having a plurality of slot groups; a plurality of feeding lines; and a dielectric disposed between the conductive plate and the plurality of feeding lines. Each of the plurality of slot groups comprises a main slot, a sub slot, and a slot coupler defined in the conductive plate. The main slot, the sub slot, and the slot coupler are configured to penetrate through the conductive plate. The slot coupler may be configured to extend from the sub slot toward to be adjacent the main slot.

In accordance with another aspect of the present disclosure, an antenna apparatus includes: a conductive plate; a plurality of feeding lines; and a dielectric disposed between the conductive plate and the plurality of feeding lines. The conductive plate comprises a plurality of main slots having a first width in a direction of a first axis and a second width in a direction of a second axis, the first width extending more than the second width and the first axis being perpendicular to the second axis; a plurality of sub slots spaced apart from each of the plurality of main slots in the direction of the first axis of each of the plurality of main slots; and a plurality of slot couplers extending from each of the plurality of sub slots to the vicinity of each of the plurality of main slots. Each of the plurality of feeding lines may be configured to extend in the direction of the short axis of the main slot so as to cross each of the plurality of main slots.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Figure 1:
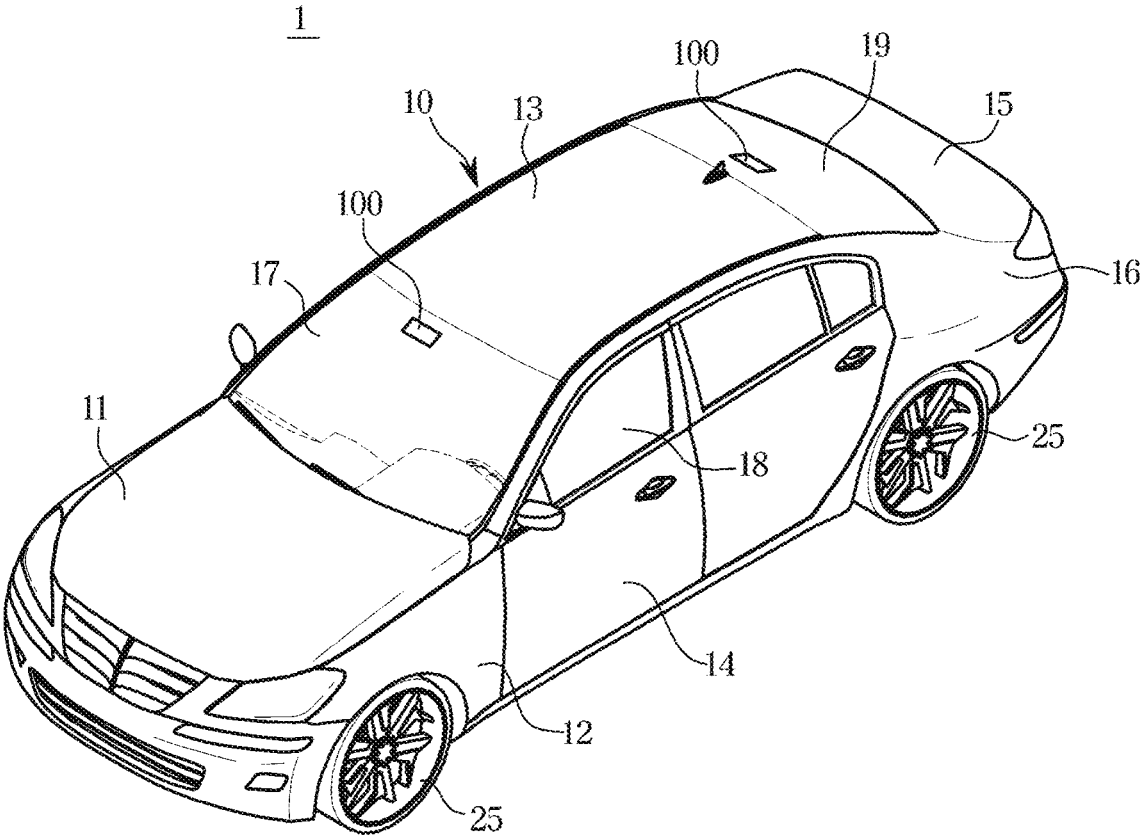
FIG. 1 is a view illustrating a vehicle according to an embodiment of the present disclosure.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order. In addition, respective descriptions of well-known functions and constructions may be omitted for increased clarity and conciseness.

Additionally, exemplary embodiments will now be described more fully hereinafter with reference to the accompanying drawings. The exemplary embodiments may, however, be embodied in many different forms and should not be construed as being limited to the embodiments set forth herein. These embodiments are provided so that this disclosure will be thorough and complete and will fully convey the exemplary embodiments to those of ordinary skill in the art. Like numerals denote like elements throughout.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular embodiments only and is not intended to be limiting. As used herein, the singular forms "a," "an," and "the," are intended to include the plural forms as well, unless the context clearly indicates otherwise.

Reference will now be made in detail to the exemplary embodiments of the present disclosure, examples of which are illustrated in the accompanying drawings, wherein like reference numerals refer to like elements throughout.

The expression, "at least one of a, b, and c," should be understood as including only a, only b, only c, both a and b, both a and c, both b and c, or all of a, b, and c.

Hereinafter, an operation principle and embodiments of the present disclosure will be described with reference to accompanying drawings.

Figure 2:
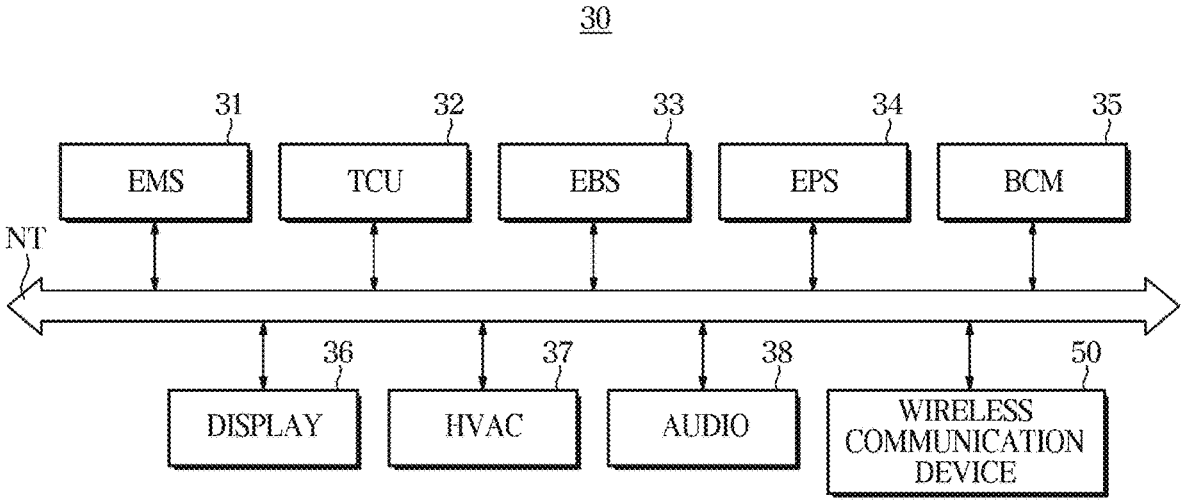
FIG. 2 is a view illustrating electronic components of a vehicle according to an embodiment of the present disclosure.

FIG. 1 is a view illustrating a vehicle according to an embodiment of the present disclosure, and FIG. 2 is a view illustrating electronic components of a vehicle according to an embodiment of the present disclosure.

A vehicle 1 may include a body 10 forming an external appearance of the vehicle 1 and accommodates a driver and/or cargo, a chassis having components of the vehicle 1 other than the body, and electronic components protecting the driver and providing convenience to the driver.

Referring to FIGS. 1 and 2, the vehicle 1 may include a hood 11, a front fender 12, a roof panel 13, doors 14, a trunk lid 15, and a quarter panel 16. In addition, in order to secure the driver's view, a front window 17 may be installed in front of the body 10, a side window 18 may be installed on the side of the body 10, and a rear window 19 may be provided at the rear of the body 10. Each of the front window 17 and the rear window 19 may be provided with an antenna apparatus 100 capable of communicating with a preceding vehicle and a following vehicle, respectively.

The vehicle 1 may include an engine management system (EMS) 31, a transmission control unit (TCU) 32, an electronic braking system (EBS) 33, an electronic power steering (EPS) 34, a body control module (BCM) 35, a display 36, a heating/ventilation/air conditioning (HVAC) 37, an audio 38, a wireless communication device 50, and the like.

The wireless communication device 50 may wirelessly communicate with another vehicle, a user terminal, or a communication repeater. The wireless communication device 50 may be used for vehicle to vehicle (V2V) communication, vehicle to infrastructure (V2I) communication, vehicle to nomadic devices (V2N) communication, and vehicle to grid (V2G) communication, and the like.

The wireless communication device 50 may transmit and receive signals through various communication methods. The wireless communication device 50 may use a short-range wireless communication method such as, for example, Dedicated Short Range Communication (DSRC) or wireless access in vehicular environments (WAVE). In addition, the wireless communication device 50 may use a mobile communication method such as, for example, Time Division Multiple Access (TDMA) or Code Division Multiple Access (CDMA).

The wireless communication device 50 may be connected to the antenna apparatus 100 for exchanging wireless signals with another vehicle, the user terminal, or the communication repeater. The antenna apparatus 100 may be installed on the front window 17 and/or the rear window 19 of the vehicle 1 as illustrated in FIG. 1.

In addition, the vehicle 1 may further include the electric components for protecting the driver and providing convenience to the driver. For example, the vehicle 1 may include electronic components 30 such as a door lock, a wiper, a power seat, a seat heater, a cluster, a room lamp, a navigation system, and a multi-function switch.

The electronic components 30 may communicate with each other through a vehicle communication network NT. For example, the electronic components 30 may transmit and receive data through Ethernet, Media Oriented Systems Transport (MOST), Flexray, Controller Area Network (CAN), Local Interconnect Network (LIN), and the like.

Figure 3A:
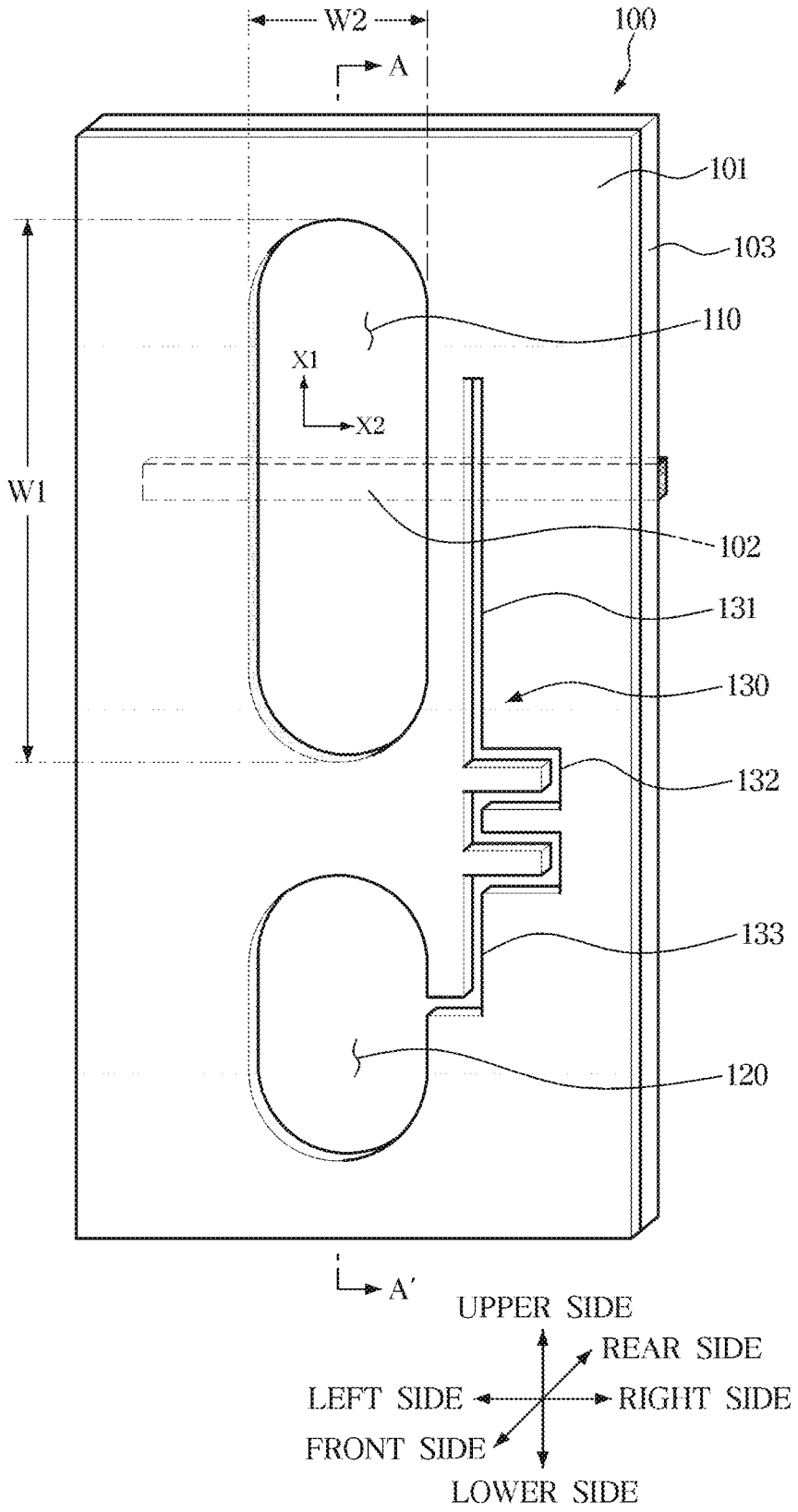
FIGS. 3A and 3B are views illustrating an antenna apparatus according to an embodiment of the present disclosure.
Figure 3B:
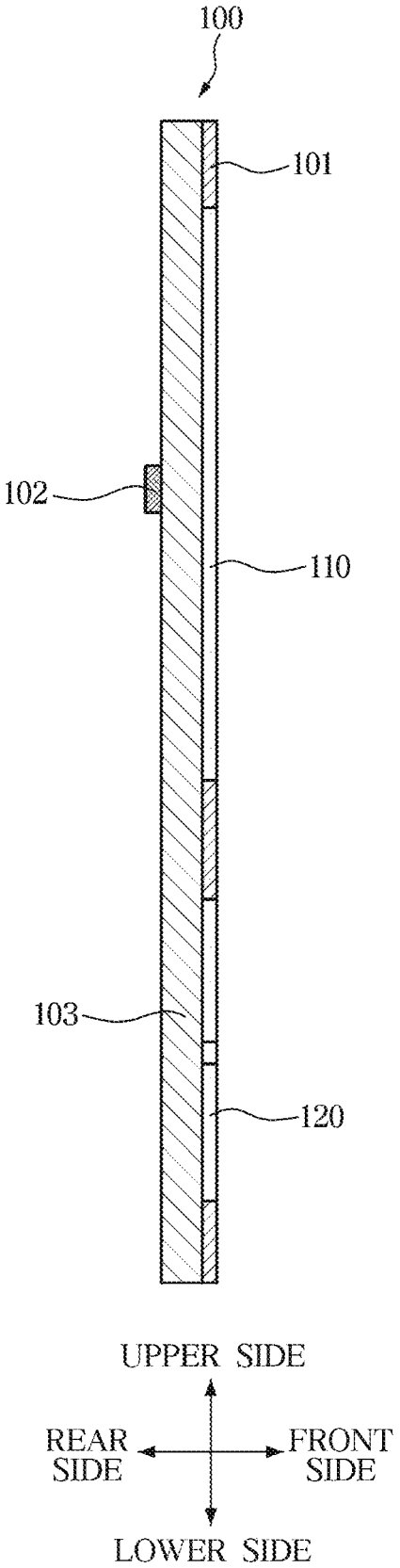
Figure 4:
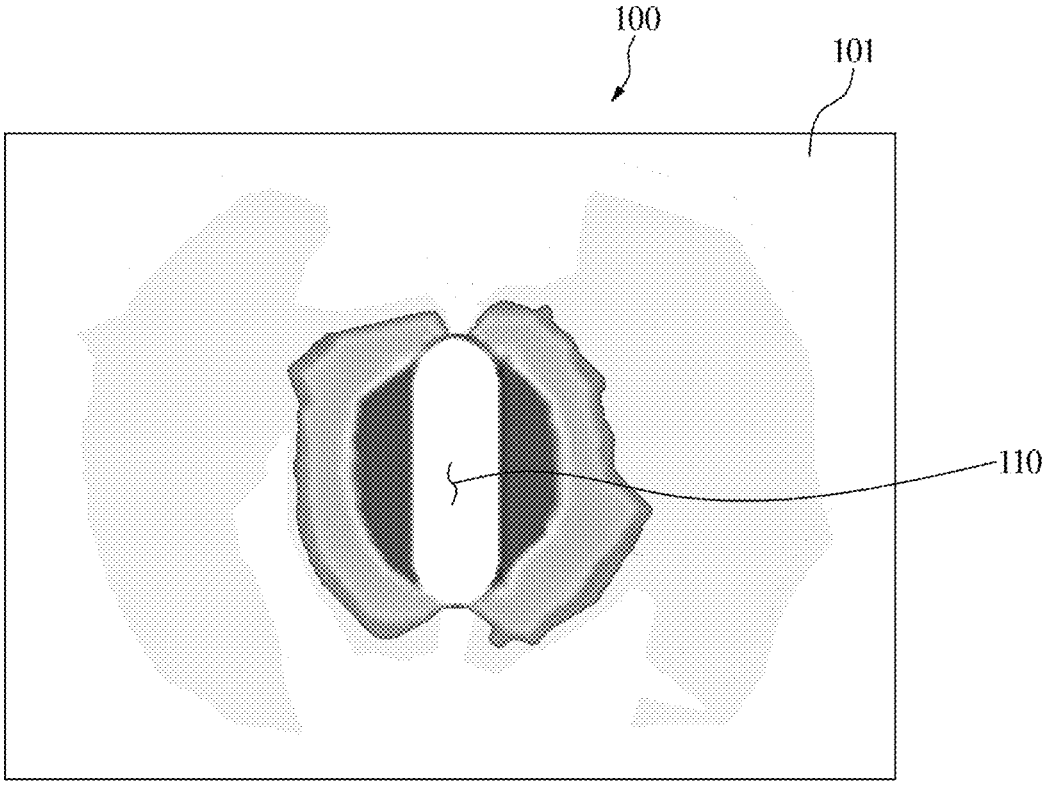
FIG. 4 is a view illustrating a current distribution of a slot antenna including a main slot.
Figure 5:
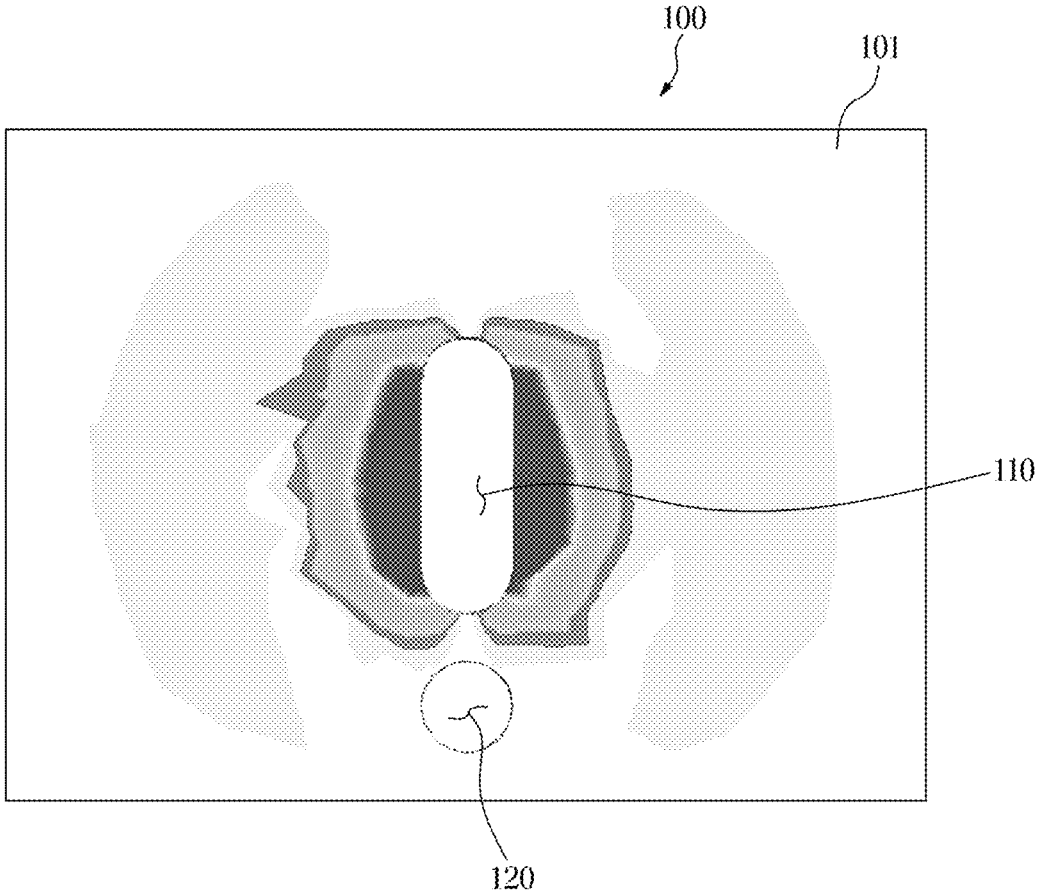
FIG. 5 is a view illustrating a current distribution of a slot antenna including a main slot and a sub slot.
Figure 6:
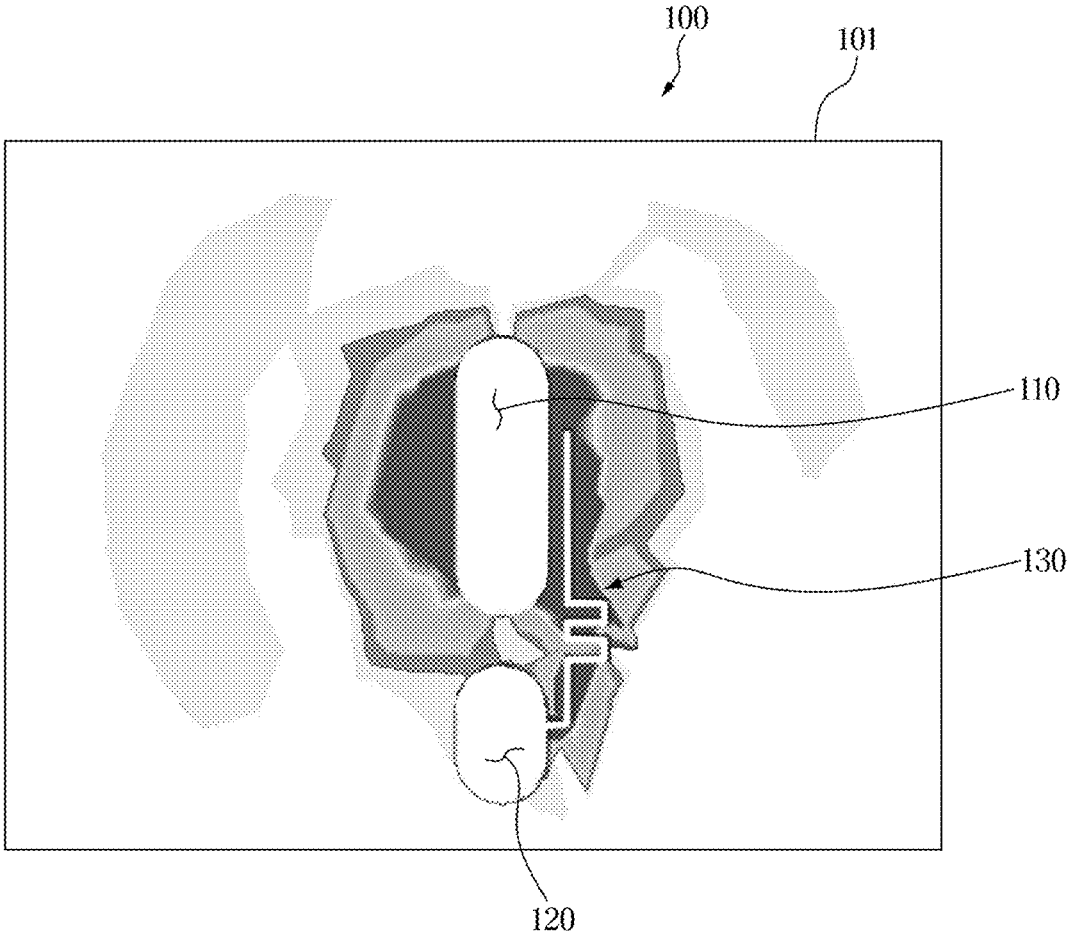
FIG. 6 is a view illustrating a current distribution of an antenna apparatus according to an embodiment of the present disclosure.
Figure 7:
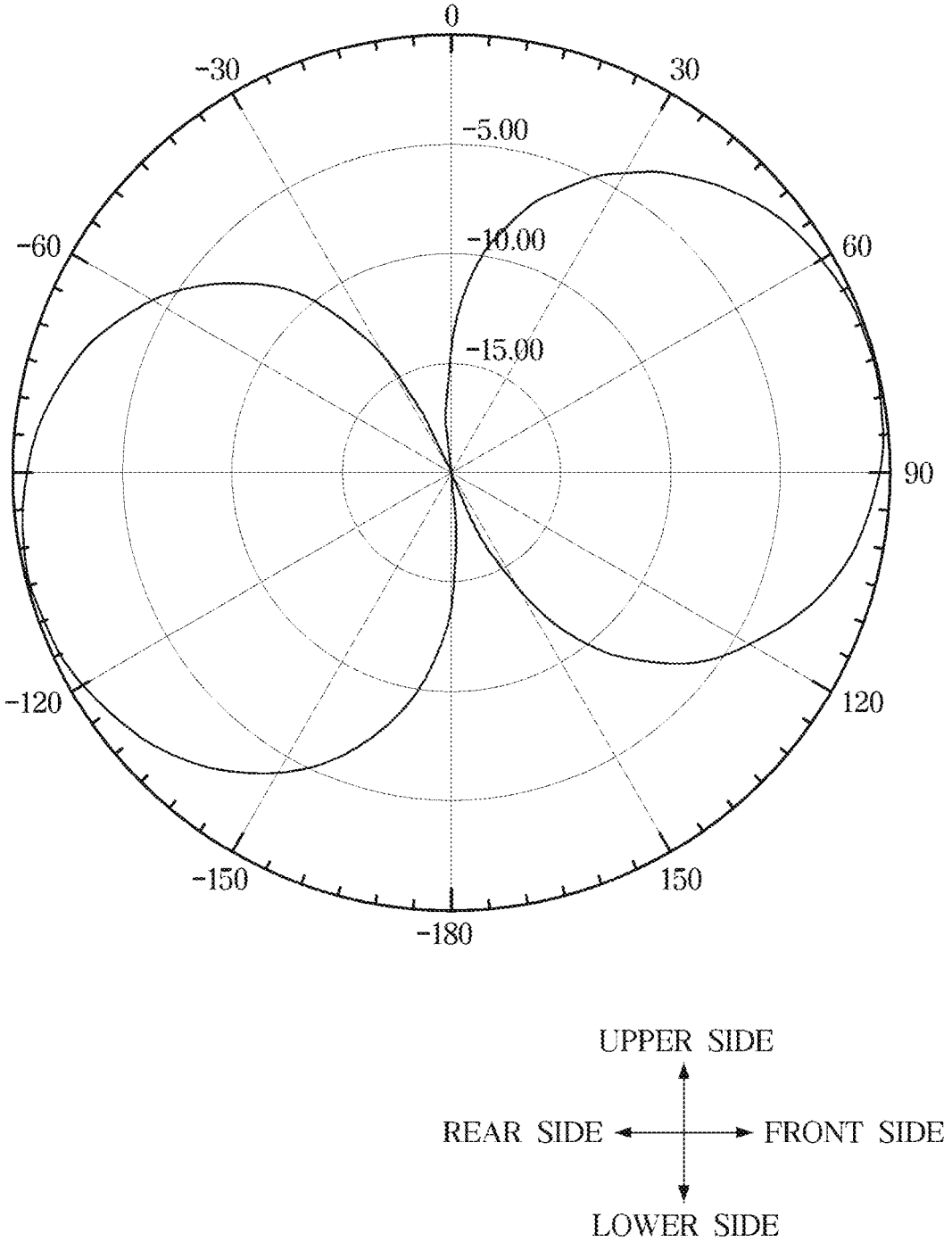
FIG. 7 is a view illustrating a radiation pattern of an antenna apparatus according to an embodiment of the present disclosure.

FIGS. 3A and 3B are views illustrating an antenna apparatus according to an embodiment of the present disclosure, FIG. 4 is a view illustrating a current distribution of a slot antenna including a main slot, FIG. 5 is a view illustrating a current distribution of a slot antenna including a main slot and a sub slot, FIG. 6 is a view illustrating a current distribution of an antenna apparatus according to an embodiment of the present disclosure, and FIG. 7 is a view illustrating a radiation pattern of an antenna apparatus according to an embodiment of the present disclosure.

FIG. 3A illustrates an appearance of the antenna apparatus 100, and FIG. 3B illustrates a section A-A' of FIG. 3A.

The antenna apparatus 100 may be a slot antenna. The slot antenna generally comprises an elongated hole or slotted flat plate. A length of the slot may depend on a frequency or wavelength of the radiated signal, and a width of the slot may depend on a bandwidth of the radiated signal. The slot antenna is widely used in a frequency band of 300 MHz to 25 GHz, and a radiation pattern of the slot antenna is approximately similar to that of a dipole antenna.

As illustrated in FIGS. 3A and 3B, the antenna apparatus 100 may include a main slot 110, a sub-slot 120, and a conductive plate 101 on which a slot coupler 130 is formed.

The conductive plate 101 may be formed of an electrically conductive material such as a metal. For example, the conductive plate 101 may be a thin metal thin film so that the antenna apparatus 100 can be bent.

In addition, the conductive plate 101 may be made of a transparent material so as not to block the driver's view. For example, the conductive plate 101 may include indium tin oxide (ITO), or may include carbon nanotubes or graphene.

The main slot 110, the sub slot 120, and the slot coupler 130 may be formed through the conductive plate 101. Radio waves may be blocked by the conductive plate 101 made of the conductive material, but may pass through the main slot 110, the sub slot 120, and the slot coupler 130.

The main slot 110 has an elongated shape. As illustrated in FIG. 3, the main slot 110 has a width W1 in a direction of a long axis X1 greater than a width W2 in a direction of a short axis X2. The width W1 in a direction of the long axis X1 may depend on the wavelength or frequency of the radio signal transmitted and received by the antenna apparatus 100. The width W2 in the direction of the short axis X2 may depend on the bandwidth of the radio signal transmitted and received by the antenna apparatus 100.

The sub slot 120 may be formed near the main slot 110. The sub slot 120 may be located on an extended line of the long axis X1 of the main slot 110. In other words, the sub slot 120 may be provided in the direction of the long axis.

The sub slot 120 may be provided to be spaced apart from the main slot 110. A distance between the sub slot 120 and the main slot 110 may depend on a radiation direction in which the antenna apparatus 100 emits the radio waves.

The sub slot 120 may be smaller than the main slot 110. In other words, an area of the sub slot 120 may be smaller than the area of the main slot 110. The size of the sub slot 120 (the width of the sub slot in the direction of the long axis of the main slot and the width of the sub slot in the direction of the short axis of the main slot) may depend on the radiation direction in which the antenna apparatus 100 emits radio waves.

In addition, the sub slot 120 may have various shapes. The sub slot 120 may be, for example, approximately circular or approximately elliptical, or square with rounded corners, or rectangular with rounded corners.

The slot coupler 130 may be defined adjacent to the main slot 110 and the sub slot 120.

The slot coupler 130 may include a coupling inductor 131 for inducing coupling with the main slot 110, a phase delay 132 for phase delaying between the main slot 110 and the sub slot 120, and a slot connector 133 connected to the sub slot 120.

Referring to FIGS. 3A and 3B, the slot coupler 130 may be connected to the sub slot 120. In other words, the slot coupler 130 may be the slot or a hole integrated with the sub slot 120. In addition, the slot coupler 130 and the sub slot 120 may be defined by one closed curve.

A portion of the slot coupler 130 connected to the sub slot 120 may be defined as the slot connector 133.

Unlike the slot coupler 130 being connected to the sub slot 120, the slot coupler 130 may be not connected to the main slot 110. In other words, the slot coupler 130 may be the slot or the hole that is not integrated with the main slot 110. Further, the slot coupler 130 and the main slot 110 may be not defined by one closed curve, and may be defined by at least two separate closed curves that do not overlap.

However, the slot coupler 130 may be provided closer to the main slot 110 than the sub slot 120 for coupling with the main slot 110. In other words, a shortest distance between the slot coupler 130 and the main slot 110 may be shorter than a shortest distance between the sub slot 120 and the main slot 110.

The portion of the slot coupler 130 that is coupled to the main slot 110 may be defined as the coupling inductor 131. The coupling inductor 131 may extend along the direction of the long axis X1 of the main slot 110 in the vicinity of the main slot 110. For example, the coupling inductor 131 may extend parallel to the main slot 110 from one end of the main slot 110 closest to the sub slot 120 toward the other end of the main slot 110. The length of the coupling inductor 131 extending from one end of the main slot 110 toward the other end of the main slot 110 may depend on the radiation direction in which the antenna apparatus 100 emits the radio waves.

The phase delay 132 may be provided between the slot connector 133 and the coupling inductor 131. The phase delay 132 may adjust a phase delay between the main slot 110 and the sub slot 120.

For example, the width of the long axis X1 of the main slot 110 may be approximately half a wavelength of the radio signal. When a phase delay of 180 degrees between the main slot 110 and the sub slot 120 is required, the main slot 110 must be spaced apart by the width of the long axis X1 of the sub slot 120 and the main slot 110. When the distance between the main slot 110 and the sub slot 120 increases, the antenna apparatus 100 may be enlarged and the efficiency of the antenna apparatus 100 may be reduced.

The phase delay 132 may increase the distance through which an electromagnetic field coupled from the main slot 110 by the coupling inductor 131 proceeds to the sub slot 120. Thereby, the phase delay between the main slot 110 and the sub slot 120 may be caused.

For example, the phase delay 132 may be formed in an alphabetic S shape or a zigzag pattern as illustrated in FIG. 3A. The phase delay 132 of the alphabetic S shape or the zigzag pattern may increase a distance through which the signal propagates between the main slot 110 and the sub slot 120, and keep a physical distance between the main slot 110 and the sub slot 120 to a minimum. Thereby, the distance between the main slot 110 and the sub slot 120 may be minimized while sufficiently securing the phase delay between the main slot 110 and the sub slot 120.

The antenna apparatus 100 may further include a feeding line 102 and a dielectric 103.

The dielectric 103 may be provided between the feeding line 102 and the conductive plate 101. The dielectric 103 may support the feeding line 102 and the conductive plate 101 and electrically isolate the feeding line 102 and the conductive plate 101.

The dielectric 103 may be composed of a nonconductor through which electricity does not flow, and may include, for example, FR-4, which is widely used in a printed circuit board. The dielectric 103 may be made of a flexible material so that the antenna apparatus 100 can be bent. For example, the dielectric 103 may include a polyimide film or a polyester film.

The dielectric 103 is provided between the feeding line 102 and the conductive plate 101. For example, the feeding line 102 does not contact the conductive plate 101 and may be provided substantially parallel to the conductive plate 101.

The feeding line 102 may be provided to extend in the direction of the short axis X2 of the main slot 110. In addition, the feeding line 102 may overlap the main slot 110 and at least a portion. In other words, as illustrated in FIGS. 3A and 3B, the main slot 110 and the feeding line 102 may cross at an angle of 90 degrees.

The feeding line 102 is electrically connected to the wireless communication device 50 of the vehicle 1. An electrical signal may be provided from the wireless communication device 50 to the feeding line 102.

When the electrical signal is input through the feeding line 102, the electromagnetic field may be formed around the feeding line 102. The electromagnetic field formed around the feeding line 102 may resonate by the main slot 110. The electromagnetic field resonating in the main slot 110 may be radiated into a free space.

A current may be induced around the main slot 110 by the electromagnetic field resonating in the main slot 110. In addition, the electromagnetic field resonating in the main slot 110 may induce the current around the main slot 110 as well as the current around the coupling inductor 131 of the slot coupler 130.

The electromagnetic field may be generated inside the coupling inductor 131 by the current induced around the coupling inductor 131. The electromagnetic field generated inside the coupling inductor 131 may propagate to the slot connector 133 along the phase delay 132. At this time, while the electromagnetic field propagates along the phase delay 132, the phase may be delayed.

The electromagnetic field propagated to the slot connector 133 may be transmitted to the sub slot 120. The electromagnetic field transmitted to the sub slot 120 may be radiated from the sub slot 120 to the free space. In other words, some of the electromagnetic fields resonating in the main slot 110 may be radiated into the free space through the sub slot 120.

In addition, while the electromagnetic field propagates from the main slot 110 to the sub slot 120 through the slot coupler 130, the current may be induced around the slot coupler 130 by the electromagnetic field.

As such, the slot coupler 130 may guide the electromagnetic field of the main slot 110 to the sub slot 120. If the slot coupler 130 does not exist, the sub slot 120 cannot be coupled to the main slot 110.

For example, the current distribution of the antenna in which only the main slot 110 is formed is as illustrated in FIG. 4. As illustrated in FIG. 4, the current distribution of the antenna may be concentrated around the main slot 110. Accordingly, it is confirmed that the radio waves are radiated from the main slot 110 to the free space.

In addition, the current distribution of the antenna in which only the main slot 110 and the sub slot 120 are formed is as illustrated in FIG. 5. As illustrated in FIG. 5, the current distribution of the antenna may be concentrated around the main slot 110. Although the sub slot 120 is located around the main slot 110, the current may be concentrated around the main slot 110, and no current may be distributed around the sub slot 120. Therefore, it is confirmed that the radio waves are radiated only in the main slot 110, and the radio waves are not radiated in the sub slot 120.

The current of the antenna apparatus 100 in which the main slot 110, the sub slot 120, and the slot coupler 130 are formed is as illustrated in FIG. 6. As illustrated in FIG. 6, the current distribution of the antenna may be concentrated around the main slot 110, but it is confirmed that the current distribution spreads to the sub slot 120 along the slot coupler 130. Accordingly, it is confirmed that the radio waves are radiated from not only the main slot 110 but also the sub slot 120.

As described above, the slot coupler 130 may couple the main slot 110 with the sub slot 120, and induce the radio waves to be radiated from not only the main slot 110 but also the sub slot 120.

Since the radio waves are radiated from not only the main slot 110 but also the sub slot 120 as described above, the radiation pattern of the antenna apparatus 100 may be different from that of a typical slot antenna.

As previously described, the radiation pattern of the slot antenna may be approximately similar to that of a dipole antenna. The typical slot antenna may radiate the radio waves in a direction perpendicular to the slot (front and rear when the direction of the long axis of the slot is defined as top/bottom) and the direction of the short axis of the slot (left and right when the direction of the long axis of the slot is defined as top/bottom). In particular, the slot antenna illustrates the radiation pattern in which a center line is perpendicular to the slot.

In comparison, the radiation pattern of the antenna apparatus 100 may radiate the radio waves in an inclined direction because the radio waves are radiated from not only the main slot 110 but also the sub slot 120.

The radiation pattern of the antenna apparatus 100 forward and backward (in the direction perpendicular to the slot) are as illustrated in FIG. 7. As illustrated in FIG. 7, the antenna apparatus 100 may have the radiation pattern directed forward and upward. In other words, the antenna apparatus 100 may have the radiation pattern biased in a direction opposite to the direction in which the sub slot 120 is provided around the main slot 110. In addition, the antenna apparatus 100 may have the radiation pattern directed backward and downward. In other words, the antenna apparatus 100 may have the radiation pattern biased in the direction in which the sub slot 120 is provided around the main slot 110.

Figure 8:
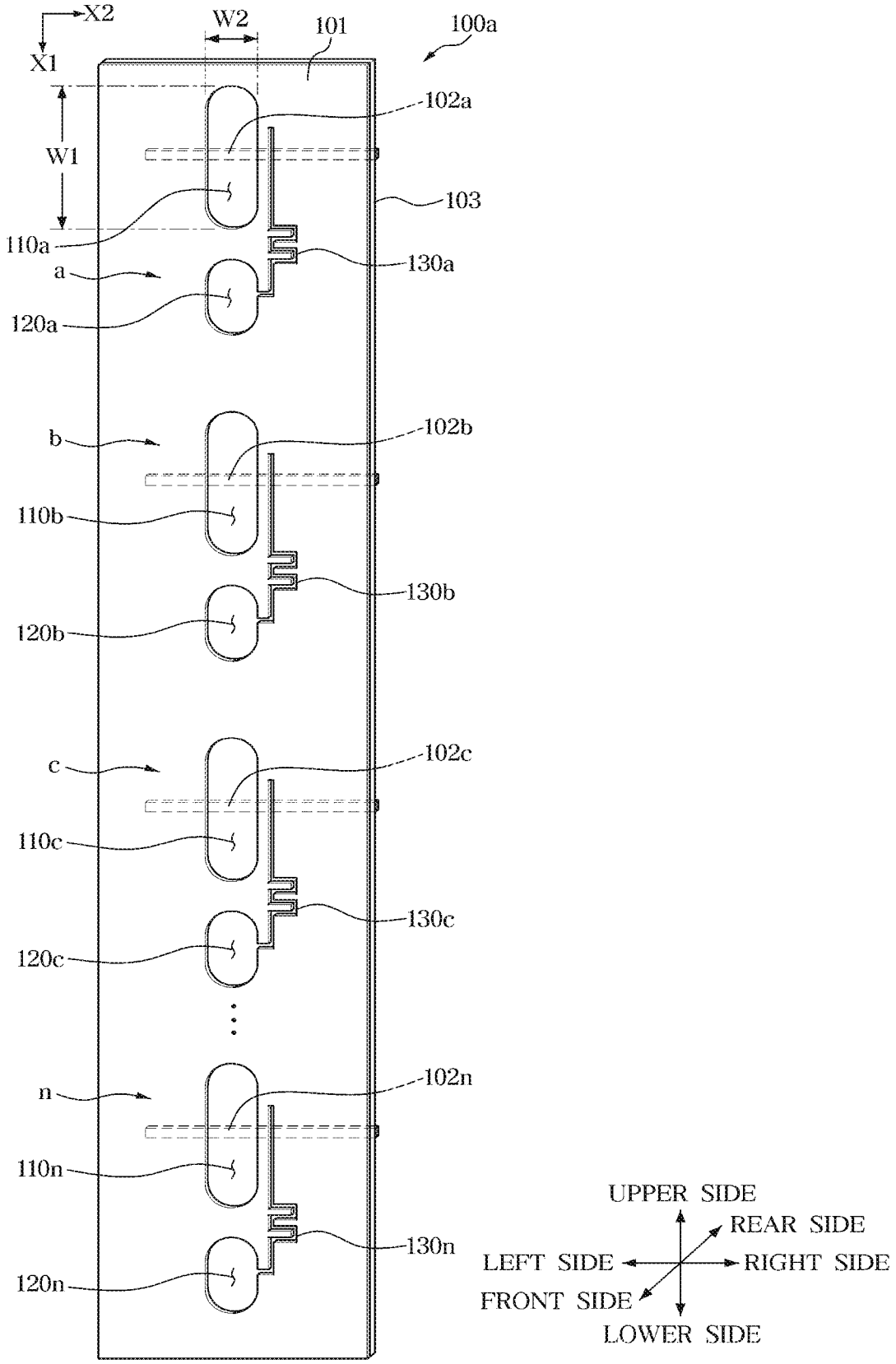
FIG. 8 is a view illustrating an antenna apparatus according to an embodiment of the present disclosure.
Figure 9:
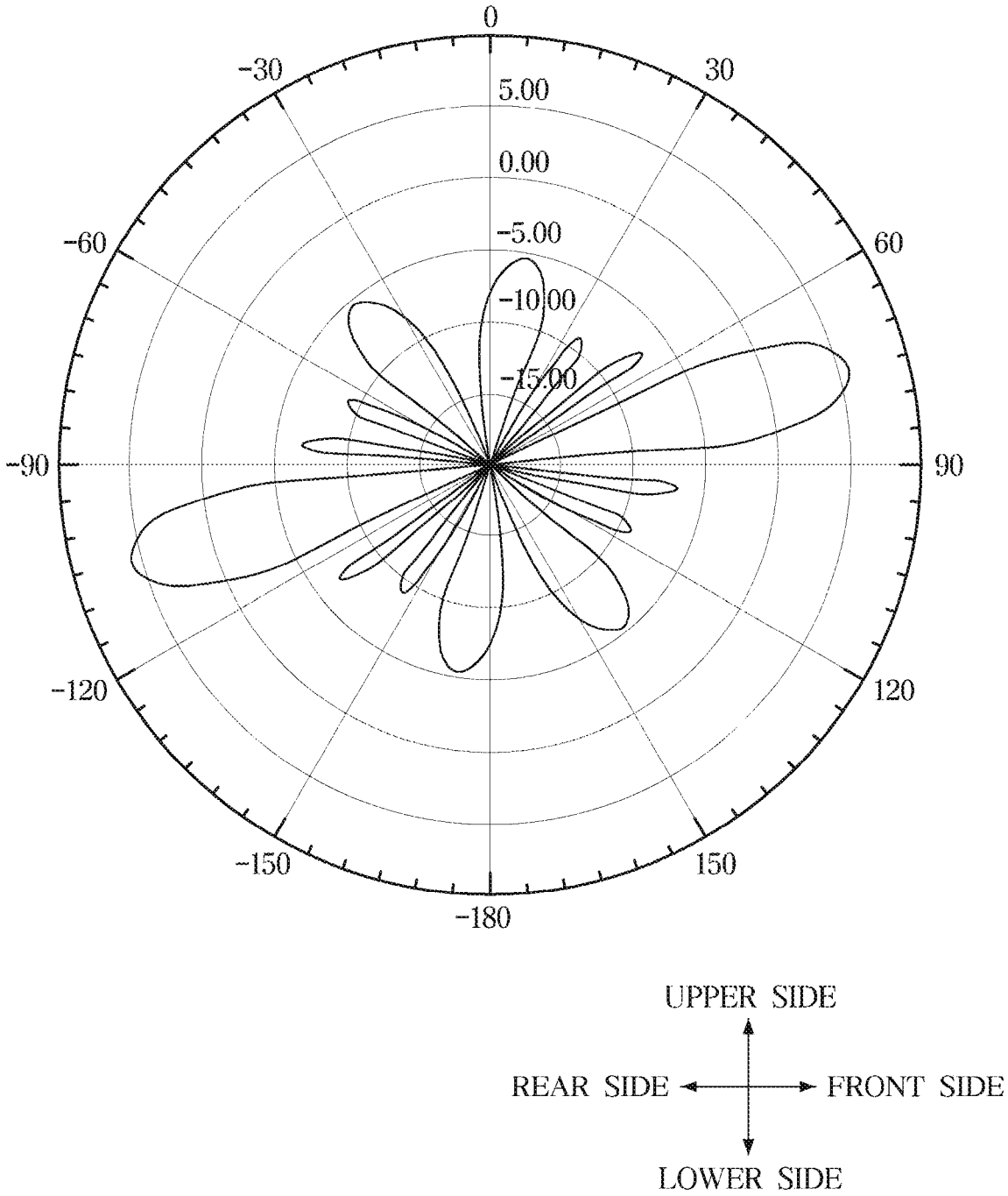
FIG. 9 is a view illustrating a radiation pattern of an antenna apparatus according to an embodiment of the present disclosure.
Figure 10A:
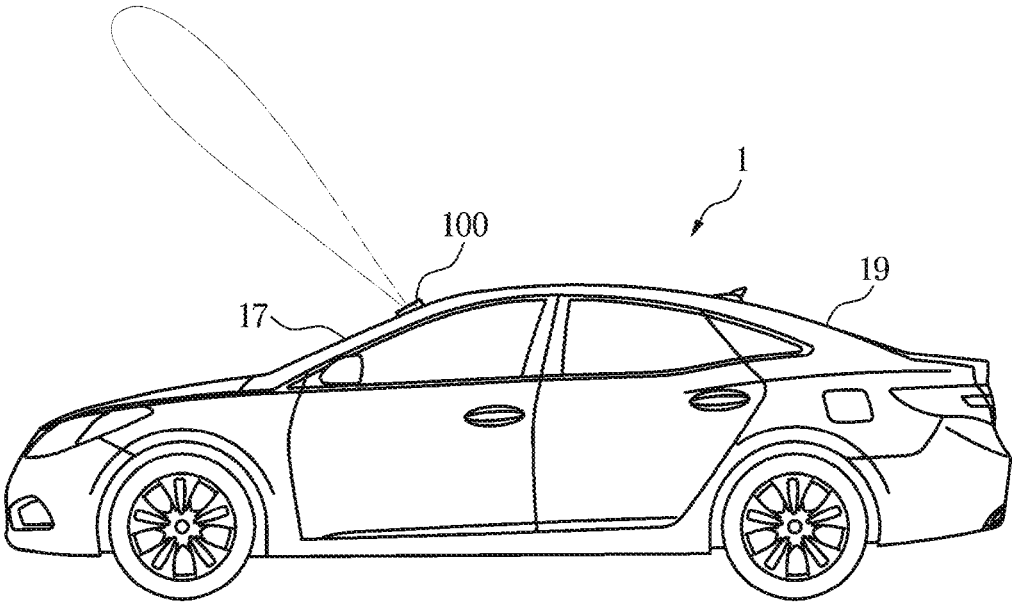
FIGS. 10A and 10B are views respectively illustrating a radiation direction of a conventional antenna apparatus installed in a vehicle and a radiation direction of an antenna apparatus according to an embodiment of the present disclosure.
Figure 10B:
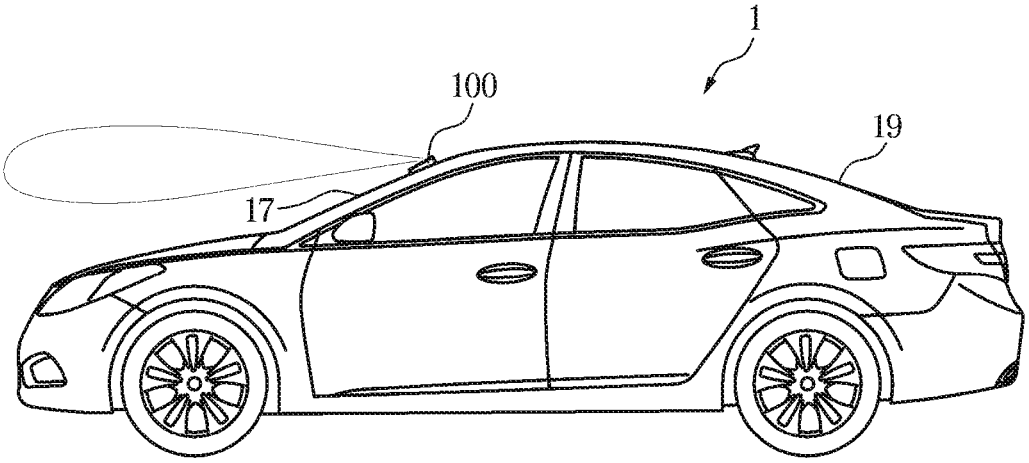

FIG. 8 is a view illustrating an antenna apparatus according to an embodiment of the present disclosure, FIG. 9 is a view illustrating a radiation pattern of an antenna apparatus according to an embodiment of the present disclosure, and FIGS. 10A and 10B views respectively illustrating a radiation direction of a conventional antenna apparatus installed in a vehicle and a radiation direction of an antenna apparatus according to an embodiment of the present disclosure.

Referring to FIG. 8, the antenna apparatus 100*a* may include the conductive plate 101*a* in which a plurality of main slots 110*a*, 110*b*, 110*c*, . . . , and 110*n*, a plurality of sub slots 120*a*, 120*b*, 120*c*, . . . , and 120*n*, and a plurality of slot couplers 130*a*, 130*b*, 130*c*, . . . , and 130*n* are formed. In FIG. 8, four main slots, four sub slots, and four slot couplers are illustrated, but the number is not limited as illustrated in the drawing.

The conductive plate 101 may be of the same material as the conductive plate illustrated in FIG. 3, and the plurality of main slots 110*a*, 110*b*, 110*c*, . . . , and 110*n*, the plurality of sub slots 120*a*, 120*b*, 120*c*, . . . , and 120*n*, and the plurality of slot couplers 130*a*, 130*b*, 130*c*, . . . , and 130*n* are formed through the conductive plate 101.

The plurality of main slots 110*a*, 110*b*, 110*c*, . . . , and 110*n* may include a first main slot 110*a*, a second main slot 110*b*, a third main slot 110*c*, . . . , and an nth main slot 110*n*.

Each of the plurality of main slots 110*a*, 110*b*, 110*c*, . . . , and 110*n* may have the elongated shape. Particularly, the width W1 of each of the plurality of main slots 110*a*, 110*b*, 110*c*, . . . , and 110*n* in the direction of the long axis X1 is greater than the width W2 in the direction of the short axis X2. In addition, each of the plurality of main slots 110*a*, 110*b*, 110*c*, . . . , and 110*n* has the same shape as the main slot 110 illustrated in FIG. 3, and may provide the same function.

The plurality of main slots 110*a*, 110*b*, 110*c*, . . . , and 110*n* may be arranged in a row in the direction of the long axis X1. For example, as illustrated in the drawing, the second main slot 110*b* may be provided under the first main slot 110*a*, and the third main slot 110*c* may be provided under the second main slot 110*b*. In other words, the plurality of main slots 110*a*, 110*b*, 110*c*, . . . , and 110*n* may be provided on an extension line of the long axis X1 of each of the plurality of main slots 110*a*, 110*b*, 110*c*, . . . , and 110*n*.

The plurality of sub slots 120*a*, 120*b*, 120*c*, . . . , and 120*n* may include a first sub slot 120*a*, a second sub slot 120*b*, a third sub slot 120*c*, . . . , and an nth sub slot 120*n*.

The plurality of sub slots 120*a*, 120*b*, 120*c*, . . . , and 120*n* may be formed in the vicinity (below the main slot in the drawing) of the plurality of main slots 110*a*, 110*b*, 110*c*, . . . , 110*n*, respectively. Particularly, the plurality of sub slots 120*a*, 120*b*, 120*c*, . . . , and 120*n* may be located on the extension line of the long axis X1 of the plurality of main slots 110*a*, 110*b*, 110*c*, . . . , and 110*n*, respectively. Each of the plurality of sub slots 120*a*, 120*b*, 120*c*, . . . , and 120*n* has the same shape as the sub slot 120 illustrated in FIG. 3, and may provide the same function.

The plurality of slot couplers 130*a*, 130*b*, 130*c*, . . . , and 130*n* may include a first slot coupler 130*a*, a second slot coupler 130*b*, a third slot coupler 130*c*, . . . , and an nth slot coupler 130*n*.

The plurality of slot couplers 130*a*, 130*b*, 130*c*, . . . , and 130*n* may be provided in the vicinity (on the right side of the main slot and the first sub slot in the drawing) of the plurality of main slots 110*a*, 110*b*, 110*c*, . . . , and 110*n* and the plurality of sub slots 120*a*, 120*b*, 120*c*, . . . , and 120*n*, have the same shape as the slot coupler 130 illustrated in FIG. 3, and may provide the same function.

The plurality of main slots 110*a*, 110*b*, 110*c*, . . . , and 110*n*, the plurality of sub slots 120*a*, 120*b*, 120*c*, . . . , and 120*n*, and the plurality of slot couplers 130*a*, 130*b*, 130*c*, . . . , and 130*n* may be divided into a plurality of slot groups a, b, c, . . . , and n.

The first slot group a may include the first main slot 110*a*, the first sub slot 120*a*, and the first slot coupler 130*a*. The second slot group b may include the second main slot 110*b*, the second sub slot 120*b*, and the second slot coupler 130*b*. In the same manner, the nth slot group n may include the nth main slot 110*n*, the nth sub slot 120*n*, and the nth slot coupler 130*n*.

The antenna apparatus 100*a* may further include a plurality of feeding lines 102*a*, 102*b*, 102*c*, . . . , and 102*n* and the dielectric 103.

The dielectric 103 may be provided between the feeding line 102 and the conductive plate 101. The dielectric 103 may support the feeding line 102 and the conductive plate 101 and electrically isolate the feeding line 102 and the conductive plate 101. The dielectric 103 may have the same shape as the dielectric illustrated in FIG. 3 and may provide the same function.

The dielectric 103 is provided between the plurality of feeding lines 102*a*, 102*b*, 102*c*, . . . and 102*n* and the conductive plate 101. For example, the plurality of feeding lines 102*a*, 102*b*, 102*c*, . . . , and 102*n* do not contact the conductive plate 101 and may be provided substantially parallel to the conductive plate 101.

The plurality of feeding lines 102*a*, 102*b*, 102*c*, . . . , and 102*n* may be provided to extend in the direction of the short axis X2 of the plurality of main slots 110*a*, 110*b*, 110*c*, . . . , and 110*n*, respectively. In addition, the plurality of feeding lines 102*a*, 102*b*, 102*c*, . . . , and 102*n* may overlap at least some of the plurality of main slots 110*a*, 110*b*, 110*c*, . . . , and 110*n*, respectively. In other words, as illustrated in FIG. 3, each of the plurality of feeding lines 102*a*, 102*b*, 102*c*, . . . , and 102*n* may cross at the angle of 90 degrees. Each of the plurality of feeding lines 102*a*, 102*b*, 102*c*, . . . , and 102*n* may have the same shape as the feeding line illustrated in FIG. 3 and may provide the same function.

As such, the antenna apparatus 100*a* may include the plurality of main slots 110*a*, 110*b*, 110*c*, . . . , and 110*n* arranged side by side and the plurality of sub slots 120*a*, 120*b*, 120*c*, . . . , and 120*n*. The plurality of main slots 110*a*, 110*b*, 110*c*, . . . , and 110*n* and the plurality of sub slots 120*a*, 120*b*, 120*c*, . . . , and 120*n* may be coupled by the plurality of slot couplers 130*a*, 130*b*, 130*c*, . . . , and 130*n*, respectively. In addition, the electrical signals may be supplied to the plurality of main slots 110*a*, 110*b*, 110*c*, . . . , and 110*n* by the plurality of feeding lines 102*a*, 102*b*, 102*c*, . . . 102*n*, respectively.

By coupling between each of the plurality of main slots 110*a*, 110*b*, 110*c*, . . . , and 110*n* and each of the plurality of sub slots 120*a*, 120*b*, 120*c*, . . . , and 120*n*, each of the plurality of slot groups a, b, c, . . . , and n may have a biased radiation pattern. For example, as illustrated in FIG. 7 described above, each of the plurality of slot groups a, b, c, . . . , and n may have the radiation pattern directed forward and upward.

The radiation pattern of the antenna apparatus 100*a* may be formed by overlapping radiation patterns of the plurality of slot groups a, b, c, . . . , and n.

The radiation patterns of the antenna apparatus 100*a* forward and backward (in the direction perpendicular to the slot) are as illustrated in FIG. 9. As illustrated in FIG. 9, the antenna apparatus 100*a* may have the radiation pattern directed forward and upward. In other words, the antenna apparatus 100*a* may have the radiation pattern biased in the direction opposite to the direction in which the sub slots 120*a*, 120*b*, 120*c*, . . . , and 120*n* are provided around the main slots 110*a*, 110*b*, 110*c*, . . . , and 110*n*.

The radiation pattern of the antenna apparatus 100*a* may have a thin and long shape of the radiation pattern compared to the radiation pattern illustrated in FIG. 7. In addition, it is confirmed that the maximum value of the radiation pattern illustrated in FIG. 7 may be approximately "0" dBi (dB isotropic), and the maximum value of the radiation pattern of the antenna apparatus 100*a* illustrated in FIG. 9 may be approximately "5" dBi. The radio waves radiated by the antenna apparatus 100*a* may be propagated to a greater distance.

As such, the upwardly or downwardly biased radiation pattern may have an advantageous effect in communication with the preceding vehicle or the following vehicle when the antenna apparatus 100*a* is installed in the front window 17 or the rear window 19. The preceding vehicle or the following vehicle may be generally driven on the same plane (road) as the vehicle 1, and it is advantageous to have the radiation pattern in a direction parallel to the road in order to communicate with the preceding vehicle or the following vehicle.

The surfaces of the front window 17 and the rear window 19 may be generally inclined with respect to the road or the plane perpendicular to the road. As such, when the typical slot antenna is disposed on the inclined front window 17 and the rear window 19, the radiation pattern of the antenna may not be parallel to the road. For example, as illustrated in FIG. 10A, when the front window 17 and the rear window 19 are arranged at an inclination of 45 degrees with respect to the road, the radiation pattern of the slot antenna may be expected to face upward by 45 degrees.

On the other hand, the antenna apparatus 100*a* may have the radiation pattern that is obliquely upward or downward. Accordingly, when the antenna apparatus 100*a* is installed in the inclined front window 17 and the rear window 19, the antenna apparatus 100*a* may exhibit the radiation pattern substantially parallel to the road. For example, as illustrated in FIG. 10B, when the antenna apparatus 100 having the radiation pattern facing forward and downward 45 degrees is installed on the front window 17 disposed at an inclination of 45 degrees, the antenna apparatus 100 may emit the radio waves in the direction approximately parallel to the road.

Figure 11:
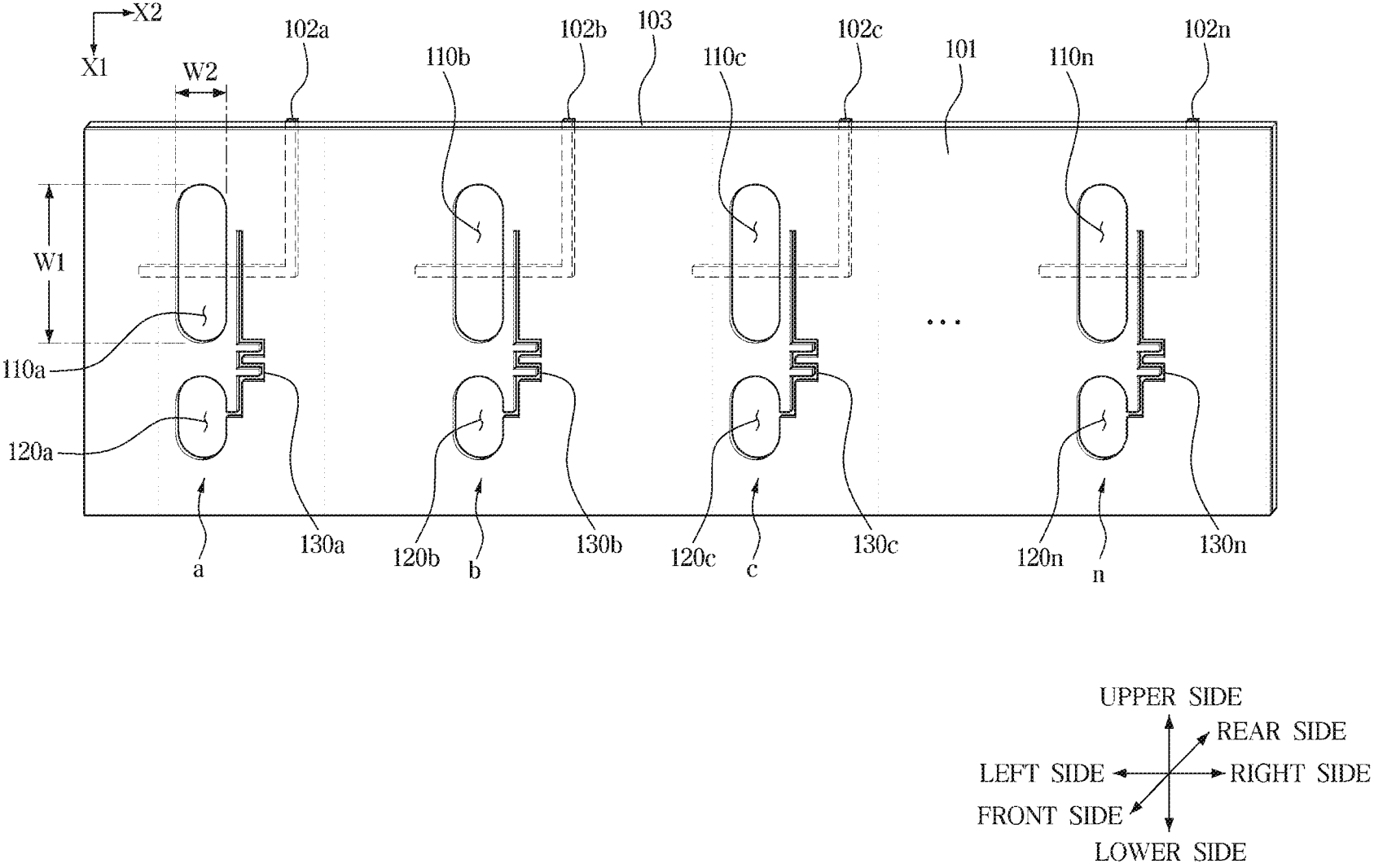
FIG. 11 is a view illustrating an antenna apparatus according to an embodiment of the present disclosure.

FIG. 11 is a view illustrating an antenna apparatus according to an embodiment of the present disclosure.

Referring to FIG. 11, the antenna apparatus 100*a* may include the conductive plate 101*a* in which a plurality of main slots 110*a*, 110*b*, 110*c*, . . . , and 110*n*, a plurality of sub slots 120*a*, 120*b*, 120*c*, . . . , and 120*n*, and a plurality of slot couplers 130*a*, 130*b*, 130*c*, . . . , and 130*n* are formed. In FIG. 11, the four main slots, the four sub slots, and the four slot couplers are illustrated, but the number is not limited as illustrated in the drawing.

The conductive plate 101 may be of the same material as the conductive plate illustrated in FIG. 3, and the plurality of main slots 110*a*, 110*b*, 110*c*, . . . , and 110*n*, the plurality of sub slots 120*a*, 120*b*, 120*c*, . . . , and 120*n*, and the plurality of slot couplers 130*a*, 130*b*, 130*c*, . . . , and 130*n* are formed through the conductive plate 101.

The plurality of main slots 110*a*, 110*b*, 110*c*, . . . , and 110*n* may include a first main slot 110*a*, a second main slot 110*b*, a third main slot 110*c*, . . . , and an nth main slot 110*n*.

Each of the plurality of main slots 110*a*, 110*b*, 110*c*, . . . , and 110*n* may have the elongated shape. Particularly, the width W1 of each of the plurality of main slots 110*a*, 110*b*, 110*c*, . . . , and 110*n* in the direction of the long axis X1 is greater than the width W2 in the direction of the short axis X2. In addition, each of the plurality of main slots 110*a*, 110*b*, 110*c*, . . . , and 110*n* has the same shape as the main slot 110 illustrated in FIG. 3, and may provide the same function.

The plurality of main slots 110*a*, 110*b*, 110*c*, . . . , and 110*n* may be arranged in a row in the direction of the short axis X2. For example, as illustrated in the drawing, the second main slot 110*b* may be provided on the right side of the first main slot 110*a*, and the third main slot 110*c* may be provided on the right side of the second main slot 110*b*. In other words, the plurality of main slots 110*a*, 110*b*, 110*c*, . . . , and 110*n* may be provided on an extension line of the short axis X2 of each of the plurality of main slots 110*a*, 110*b*, 110*c*, . . . , and 110*n*.

The plurality of sub slots 120*a*, 120*b*, 120*c*, . . . , and 120*n* may include a first sub slot 120*a*, a second sub slot 120*b*, a third sub slot 120*c*, . . . , and an nth sub slot 120*n*. The plurality of sub slots 120*a*, 120*b*, 120*c*, . . . , and 120*n* may be formed in the vicinity (below the main slot in the drawing) of the plurality of main slots 110*a*, 110*b*, 110*c*, . . . , 110*n*, respectively. Each of the plurality of sub slots 120*a*, 120*b*, 120*c*, . . . , and 120*n* has the same shape as the sub slot 120 illustrated in FIG. 3, and may provide the same function.

The plurality of slot couplers 130*a*, 130*b*, 130*c*, . . . , and 130*n* may include a first slot coupler 130*a*, a second slot coupler 130*b*, a third slot coupler 130*c*, . . . , and an nth slot coupler 130*n*. The plurality of slot couplers 130*a*, 130*b*, 130*c*, . . . , and 130*n* may be provided in the vicinity (on the right side of the main slot and the first sub slot in the drawing) of the plurality of main slots 110*a*, 110*b*, 110*c*, . . . , and 110*n* and the plurality of sub slots 120*a*, 120*b*, 120*c*, . . . , and 120*n*, have the same shape as the slot coupler 130 illustrated in FIG. 3, and may provide the same function.

The plurality of main slots 110*a*, 110*b*, 110*c*, . . . , and 110*n*, the plurality of sub slots 120*a*, 120*b*, 120*c*, . . . , and 120*n*, and the plurality of slot couplers 130*a*, 130*b*, 130*c*, . . . , and 130*n* may be divided into a plurality of slot groups a, b, c, . . . , and n.

The first slot group a may include the first main slot 110*a*, the first sub slot 120*a*, and the first slot coupler 130*a*. The second slot group b may include the second main slot 110*b*, the second sub slot 120*b*, and the second slot coupler 130*b*. In the same manner, the nth slot group n may include the nth main slot 110*n*, the nth sub slot 120*n*, and the nth slot coupler 130*n*.

The antenna apparatus 100*a* may further include a plurality of feeding lines 102*a*, 102*b*, 102*c*, . . . , and 102*n* and the dielectric 103.

The dielectric 103 may be provided between the feeding line 102 and the conductive plate 101. The dielectric 103 is provided between the plurality of feeding lines 102*a*, 102*b*, 102*c*, . . . and 102*n* and the conductive plate 101. The plurality of feeding lines 102*a*, 102*b*, 102*c*, . . . , and 102*n* may be provided to extend in the direction of the short axis X2 of the plurality of main slots 110*a*, 110*b*, 110*c*, . . . , and 110*n*, respectively. Each of the plurality of feeding lines 102*a*, 102*b*, 102*c*, . . . , and 102*n* may have the same shape as the feeding line illustrated in FIG. 3 and may provide the same function.

As such, the antenna apparatus 100*a* may include the plurality of main slots 110*a*, 110*b*, 110*c*, . . . , and 110*n* arranged side by side and the plurality of sub slots 120*a*, 120*b*, 120*c*, . . . , and 120*n*. The plurality of main slots 110*a*, 110*b*, 110*c*, . . . , and 110*n* and the plurality of sub slots 120*a*, 120*b*, 120*c*, . . . , and 120*n* may be coupled by the plurality of slot couplers 130*a*, 130*b*, 130*c*, . . . , and 130*n*, respectively. In addition, the electrical signals may be supplied to the plurality of main slots 110*a*, 110*b*, 110*c*, . . . , and 110*n* by the plurality of feeding lines 102*a*, 102*b*, 102*c*, . . . 102*n*, respectively.

By coupling between each of the plurality of main slots 110*a*, 110*b*, 110*c*, . . . , and 110*n* and each of the plurality of sub slots 120*a*, 120*b*, 120*c*, . . . , and 120*n*, each of the plurality of slot groups a, b, c, . . . , and n may have a biased radiation pattern. The radiation pattern of the antenna apparatus 100*a* may be formed by overlapping radiation patterns of the plurality of slot groups a, b, c, . . . , and n.

The antenna apparatus 100 may have the radiation pattern directed forward and upward. In other words, the antenna apparatus 100*a* may have the radiation pattern biased in the direction opposite to the direction in which the sub slots 120*a*, 120*b*, 120*c*, . . . , and 120*n* are provided around the main slots 110*a*, 110*b*, 110*c*, . . . , and 110*n*.

According to the embodiments of the present disclosure, it is possible to provide the antenna apparatus disposed on the front window and/or the rear window.

Further, according to the embodiments of the present disclosure, it is possible to provide the antenna apparatus capable of beam-forming from the inclined front window and/or rear window toward the front and/or rear of the vehicle. Thereby, the antenna apparatus may communicate seamlessly with the preceding vehicle and/or the following vehicle.

Exemplary embodiments of the present disclosure have been described above. In the exemplary embodiments described above, some components may be implemented as a "module". Here, the term 'module' means, but is not limited to, a software and/or hardware component, such as a Field Programmable Gate Array (FPGA) or Application Specific Integrated Circuit (ASIC), which performs certain tasks. A module may advantageously be configured to reside on the addressable storage medium and configured to execute on one or more processors.

Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The operations provided for in the components and modules may be combined into fewer components and modules or further separated into additional components and modules. In addition, the components and modules may be implemented such that they execute one or more CPUs in a device.

With that being said, and in addition to the above described exemplary embodiments, embodiments can thus be implemented through computer readable code/instructions in/on a medium, e.g., a computer readable medium, to control at least one processing element to implement any above described exemplary embodiment. The medium can correspond to any medium/media permitting the storing and/or transmission of the computer readable code.

The computer-readable code can be recorded on a medium or transmitted through the Internet. The medium may include Read Only Memory (ROM), Random Access Memory (RAM), Compact Disk-Read Only Memories (CD-ROMs), magnetic tapes, floppy disks, and optical recording medium. Also, the medium may be a non-transitory computer-readable medium. The media may also be a distributed network, so that the computer readable code is stored or transferred and executed in a distributed fashion. Still further, as only an example, the processing element could include at least one processor or at least one computer processor, and processing elements may be distributed and/or included in a single device.

While exemplary embodiments have been described with respect to a limited number of embodiments, those skilled in the art, having the benefit of this disclosure, will appreciate that other embodiments can be devised which do not depart from the scope as disclosed herein. Accordingly, the scope should be limited only by the attached claims.

Embodiments of the present disclosure have thus far been described with reference to the accompanying drawings. It should be obvious to a person of ordinary skill in the art that the disclosure may be practiced in other forms than the embodiments as described above without changing the technical idea or essential features of the disclosure. The above embodiments are only by way of example, and should not be interpreted in a limited sense.

What is claimed is:

1. An antenna apparatus comprising:

a conductive plate having a plurality of slot groups;

a plurality of feeding lines; and a dielectric disposed between the conductive plate and the plurality of feeding lines, wherein each of the plurality of slot groups comprises a main slot, a sub slot, and a slot coupler defined in the conductive plate, wherein the main slot, the sub slot, and the slot coupler are formed through the conductive plate, and wherein the slot coupler is connected to the sub slot and coupled to the main slot.

2. The antenna apparatus according to claim 1, wherein each of the main slots has a first width extending in a direction of a first axis and a second width extending in a direction of a second axis, the first width extending more than the second width and the first axis being perpendicular to the second axis, and wherein another main slot adjacent to the main slot is spaced apart from the main slot in the direction of the first axis of the main slot.

3. The antenna apparatus according to claim 1, wherein each of the main slots has a first width in a direction of a first axis and a second width in a direction of a second axis, the first width extending more than the second width and the first axis being perpendicular to the second axis, and wherein another main slot adjacent to the main slot is spaced apart from the main slot in the direction of the second axis of the main slot.

4. The antenna apparatus according to claim 1, wherein the main slot has a first width extending in a direction of a first axis and a second width extending in a direction of a second axis, the first width extending more than the second width and the first axis being perpendicular to the second axis, and wherein the sub slot is spaced apart from the main slot in the direction of the first axis of the main slot.

5. The antenna apparatus according to claim 4, wherein each of the plurality of feeding lines is configured to extend in the direction of the second axis of the main slot so as to cross the main slot.

6. The antenna apparatus according to claim 4, wherein the slot coupler comprises:

a coupling inductor extending parallel to the main slot adjacent the main slot;

a slot connector configured to communicate with the sub slot; and a phase delay disposed between the coupling inductor and the slot connector.

7. The antenna apparatus according to claim 6, wherein the phase delay has an "S" shape that extends from the coupling inductor to the slot connector.

8. The antenna apparatus according to claim 1, wherein the slot coupler is configured to couple the sub slot to the main slot.

9. A vehicle comprising:

a front window;

a wireless communication device; and an antenna apparatus disposed on the front window, the antenna apparatus configured to be electrically connected to the wireless communication device, wherein the antenna apparatus comprises:

a conductive plate having a plurality of slot groups;

a plurality of feeding lines; and a dielectric disposed between the conductive plate and the plurality of feeding lines, wherein each of the plurality of slot groups comprises a main slot, a sub slot, and a slot coupler defined in the conductive plate, wherein the main slot, the sub slot, and the slot coupler formed through the conductive plate, and wherein the slot coupler is connected to the sub slot and coupled to the main slot.

10. The vehicle according to claim 9, wherein each of the main slots included in the plurality of slot groups has a first width extending in a direction of a first axis and a second width extending in a direction of a second axis, the first width extending more than the second width and the first axis being perpendicular to the second axis, and wherein another main slot adjacent to the main slot is spaced apart from the main slot in the direction of the first axis of the main slot.

11. The vehicle according to claim 9, wherein each of the main slots included in the plurality of slot groups has a first width extending in a direction of a first axis and a second width extending in a direction of a second axis, the first width extending more than the second width and the first axis being perpendicular to the second axis, and wherein another main slot adjacent to the main slot is spaced apart from the main slot in the direction of the second axis of the main slot.

12. The vehicle according to claim 9, wherein the main slot has a first width extending in a direction of a first axis and a second width extending in a direction of a second axis, the first width extending more than the second width and the first axis being perpendicular to the second axis, and wherein the sub slot is spaced apart from the main slot in the direction of the first axis of the main slot.

13. The vehicle according to claim 12, wherein each of the plurality of feeding lines is configured to extend in the direction of the second axis of the main slot so as to cross the main slot.

14. The vehicle according to claim 12, wherein the slot coupler comprises:

a coupling inductor extending parallel to the main slot adjacent the main slot;

a slot connector configured to communicate with the sub slot; and a phase delay disposed between the coupling inductor and the slot connector.

15. The vehicle according to claim 14, wherein the phase delay has an "S" shape that extends from the coupling inductor to the slot connector.

16. The vehicle according to claim 9, wherein the slot coupler is configured to couple the sub slot to the main slot.

17. The vehicle according to claim 9, wherein the antenna apparatus is configured to radiate radio waves in a direction parallel to a road on which the vehicle is driving.

18. An antenna apparatus comprising:

a conductive plate;

a plurality of feeding lines; and a dielectric disposed between the conductive plate and the plurality of feeding lines, wherein the conductive plate includes:

a plurality of main slots having a first width in a direction of a first axis and a second width in a direction of a second axis the first width extending more than the second width and the first axis being perpendicular to the second axis;

a plurality of sub slots spaced apart from each of the plurality of main slots in the direction of the first axis of each of the plurality of main slots; and a plurality of slot couplers, each of which is connected to each of the plurality of sub slots and coupled to each of the plurality of main slots, wherein each of the plurality of feeding lines is configured to extend in the direction of the second axis of the main slot so as to cross each of the plurality of main slots.

* * * * *